United States Patent [19]

Simpson

[11] 4,343,059

[45] Aug. 10, 1982

[54] RADIOACTIVE HOT CELL ACCESS HOLE DECONTAMINATION MACHINE

[75] Inventor: William E. Simpson, Richland, Wash.

[73] Assignee: The United States of America as represented by the United States Department of Energy, Washington, D.C.

[21] Appl. No.: 251,643

[22] Filed: Apr. 6, 1981

[51] Int. Cl.[3] ..... A46B 13/02

[52] U.S. Cl. ..... 15/21 E; 15/104.1 R

[58] Field of Search ..... 15/21 R, 21 D, 21 C, 15/56, 101, 104.1 R, 104.1 C, 246.5

[56] References Cited

U.S. PATENT DOCUMENTS 2,115,439 4/1938 Wolfner ..... 15/104.1 C X 3,714,673 2/1973 Brown ..... 15/104.1 R

FOREIGN PATENT DOCUMENTS 679264 8/1979 U.S.S.R. ..... 15/56

*Primary Examiner*—Edward L. Roberts

*Attorney, Agent, or Firm*—Douglas E. Erickson; Richard E. Constant; Richard G. Besha

[57] ABSTRACT

Radioactive hot cell access hole decontamination machine. A mobile housing has an opening large enough to encircle the access hole and has a shielding door, with a door opening and closing mechanism, for uncovering and covering the opening. The housing contains a shaft which has an apparatus for rotating the shaft and a device for independently translating the shaft from the housing through the opening and access hole into the hot cell chamber. A properly sized cylindrical pig containing wire brushes and cloth or other disks, with an arrangement for releasably attaching it to the end of the shaft, circumferentially cleans the access hole wall of radioactive contamination and thereafter detaches from the shaft to fall into the hot cell chamber.

8 Claims, 5 Drawing Figures

RADIOACTIVE HOT CELL ACCESS HOLE DECONTAMINATION MACHINE

The U.S. Government has rights in this invention pursuant to Contract No. DE-AC06-77RL01030 between the U.S. Department of Energy and the Rockwell International Corporation.

BACKGROUND OF THE INVENTION

The present invention relates generally to radioactive decontamination devices and more particularly to a machine for removing radioactive contamination from the wall of an access hole of a radioactive hot cell.

Hot cells are shielded chambers containing radioactive material. The shielding is usually in the form of several feet of concrete for the walls, floor, and ceiling, with several feet of special glass for the viewing windows. Each hot cell generally has one or more access holes or ports in the thick concrete walls. Of varying size, such as 10 inches in diameter, they are generally of a right circular cylindrical shape aligned horizontally to the floor of the hot cell. The access holes serve as passageways to put radioactive material and tools into the hot cell and to remove them from the hot cell. Access holes are also used for manipulators installed in the radiation shielding wall. Radioactive contamination may occur on the walls of an access hole, such as during the removal of a manipulator for maintenance. Quite often the boot covering the inner section of the manipulator is damaged, burned, or badly contaminated. When the unit is withdrawn, particles fall off in the hole. The hole is sometimes as much as three and one half or four feet long. These radioactive particles may also be thermally hot and may damage the new boot if not removed. They will also contaminate the operating gallery side of the shielding wall if allowed to escape after a manipulator is removed.

Prior to this invention, radioactive contamination was removed from the walls of access holes of hot cells by individuals using manual cleaning techniques. A lead shield would be installed in the hole and individuals would hand clean behind it, manually scrubbing the hole, with simple tools such as mops, swabs, and scrapers. These individuals would receive considerable radiation exposure in the hole and during handling of the swabs and shield.

SUMMARY OF THE INVENTION

It is an object of the invention to decontaminate radioactive hot cell access holes. It is another object of the invention to decontaminate such access holes with little or virtually no radiation exposure to individuals performing the decontamination.

It is a further object of the invention to quickly decontaminate such access holes.

Additional objects, advantages, and novel features of the invention will be set forth in part in the description which follows, and in part will become apparent to those skilled in the art upon examination of the following or may be learned by practice of the invention. The objects and advantages of the invention may be realized and attained by means of the instrumentalities and the combinations particularly pointed out in the appended claims.

To achieve the foregoing and other objects and in accordance with the purpose of the present invention, as embodied and broadly described herein, the radioactive hot cell access hole decontamination machine, for decontaminating generally horizontal right circular cylindrical access holes, may comprise a housing, a shield door, a shield door opening and closing mechanism, a shaft, a shaft rotating apparatus, a shaft translating device, a cleaning pig, and an arrangement for attaching the cleaning pig to the end of the shaft. The housing may be moved to abut the outside of the access hole such that an opening in the housing encompasses the access hole. The shielding door is connected to the housing and covers the opening. The shaft is aligned generally horizontally within the housing. The device for translating the shaft moves the end of the shaft, which is connected to the cleaning pig, from within the housing out through the opening and the access hole, without the shaft touching the access hole wall, into the hot cell chamber and back out again. The cleaning pig has the shape of a generally right circular cylinder and has a diameter which is large enough for the cleaning pig to have its circumference press against the access hole wall. The arrangement for attaching the cleaning pig to the end of the shaft allows the shaft to rotate and translate the pig through the access hole and thereafter detaches the pig from the shaft to have the pig fall into the hot cell chamber.

Several benefits and advantages are derived from the invention. Decontamination of access holes can now be accomplished essentially without any exposure to personnel. The machine substitutes rapid mechanised decontamination for the slower existing decontamination techniques which utilize hand cleaning. The machine's feature of depositing the used cleaning pig in the hot cell chamber virtually eliminates the possibility of carrying contamination to the outside of the hot cell chamber during the decontamination process.

BRIEF DESCRIPTION OF THE DRAWINGS

The accompanying drawings, which are incorporated in and form a part of this specification, illustrate an embodiment of the present invention and, together with the description, serve to explain the principles of the invention. In the drawings.

DETAILED DESCRIPTION OF THE INVENTION

Reference will now be made in detail to the present preferred embodiment of the invention, an example of which is illustrated in the accompanying drawings.

Figure 1:
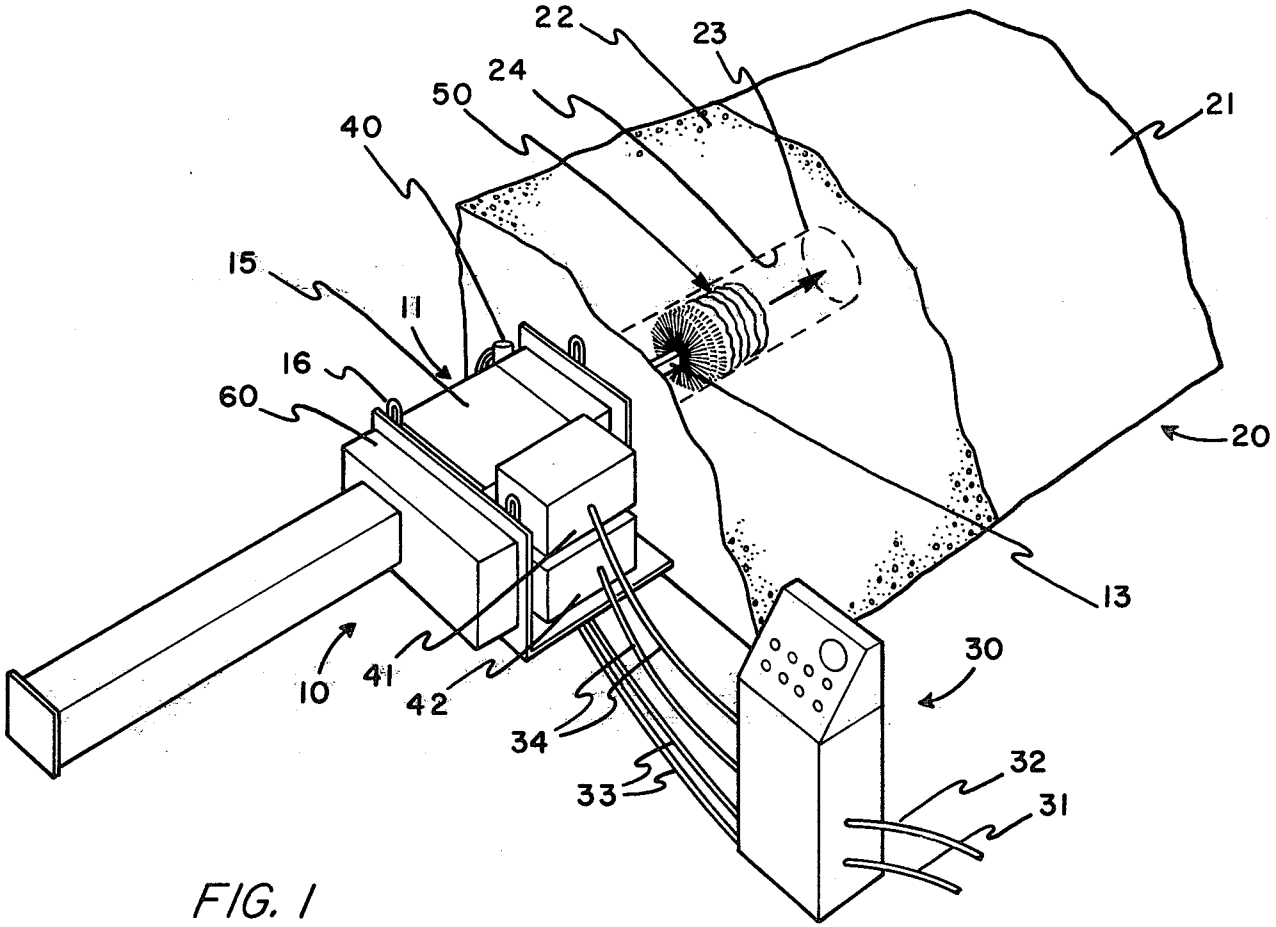
FIG. 1 is a perspective view of the decontamination machine with a cutaway view of part of a hot cell chamber.

In FIG. 1, the decontamination machine 10 and a cutaway part of a hot cell 20 are shown. The hot cell 20 contains radioactivity in an enclosed chamber 21. Radiation shielding is accomplished by thick concrete sides 22. Only part of a hot cell 20 is shown in FIG. 1, and it is understood that the chamber 21 is completely surrounded by concrete shielding walls, floor, and ceiling. A generally right circular cylindrical and horizontal access hole 23 has been formed in a concrete side 22. The hot cell 20 may have a plurality of access holes 23. Radioactive material may be entered or removed from the chamber 21 through such access holes 23. Access holes 23 are also used by manipulators with the operator, standing outside of the hot cell, directing the movement of the manipulator within the hot cell by means of various linkages. Removal of radioactive material or equipment from the chamber 21 through the access hole 23, such as a manipulator and boot, can result in contamination depositing on the wall 24 of the access hole 23.

The decontamination machine 10 is designed to remove such contamination from the access hole 23. The decontamination machine 10 has a housing 11 from which a shaft 12 having an end 13 attached to a cleaning pig 50 rotates and translates through the access hole 23 removing contamination from the access hole wall 24.

The decontamination machine 10 is powered by electricity and compressed air from a control cart 30. Plant compressed air is supplied to the control cart by a hose 31. Plant electricity is supplied to the control cart by an electric cable 32. Air hoses 33 and electric cables 34 connect the control cart 30 with the decontamination machine 10.

Figure 2:
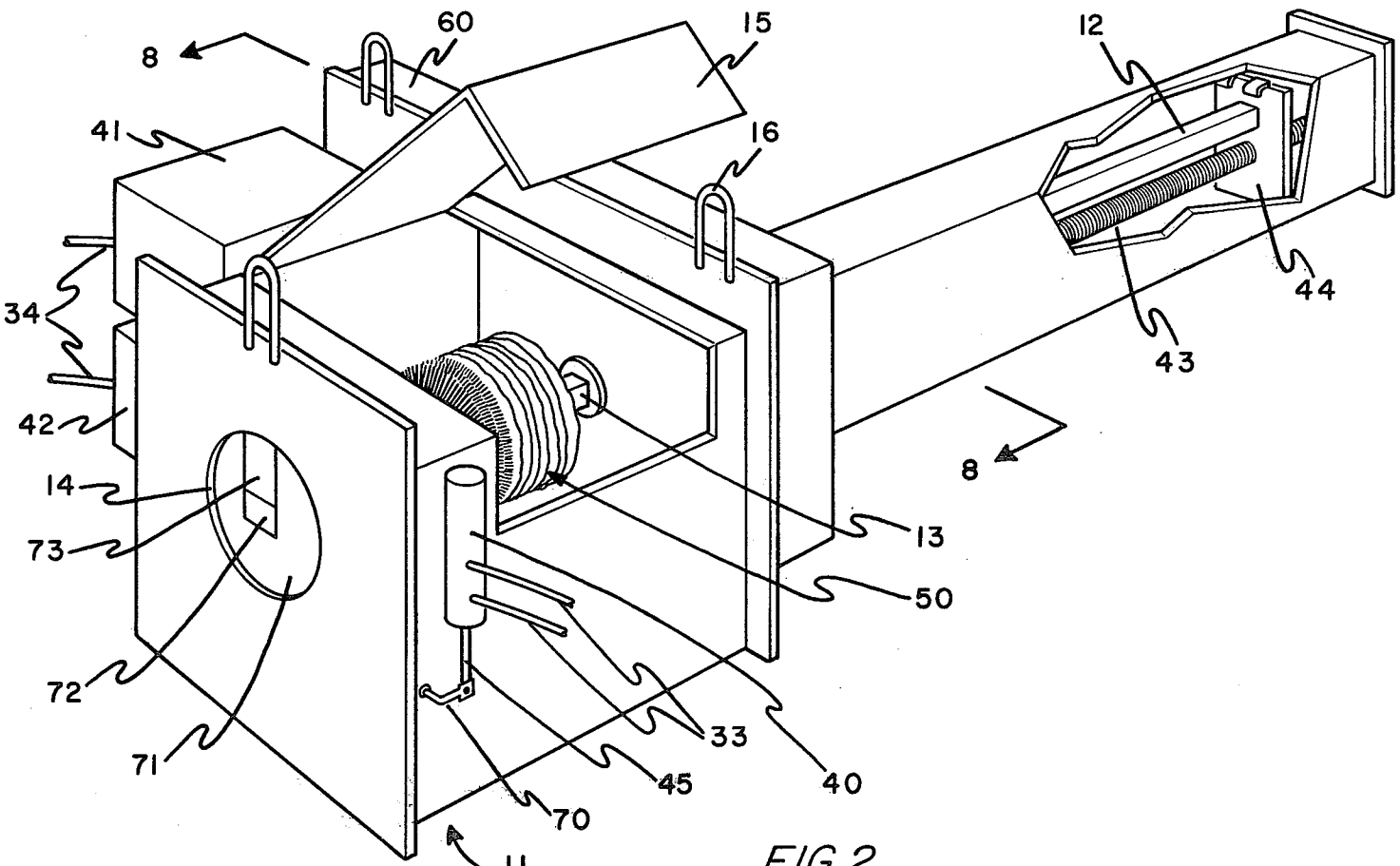
FIG. 2 is an enlarged, partial cutaway view of the decontamination machine shown in FIG. 1.
Figure 3:
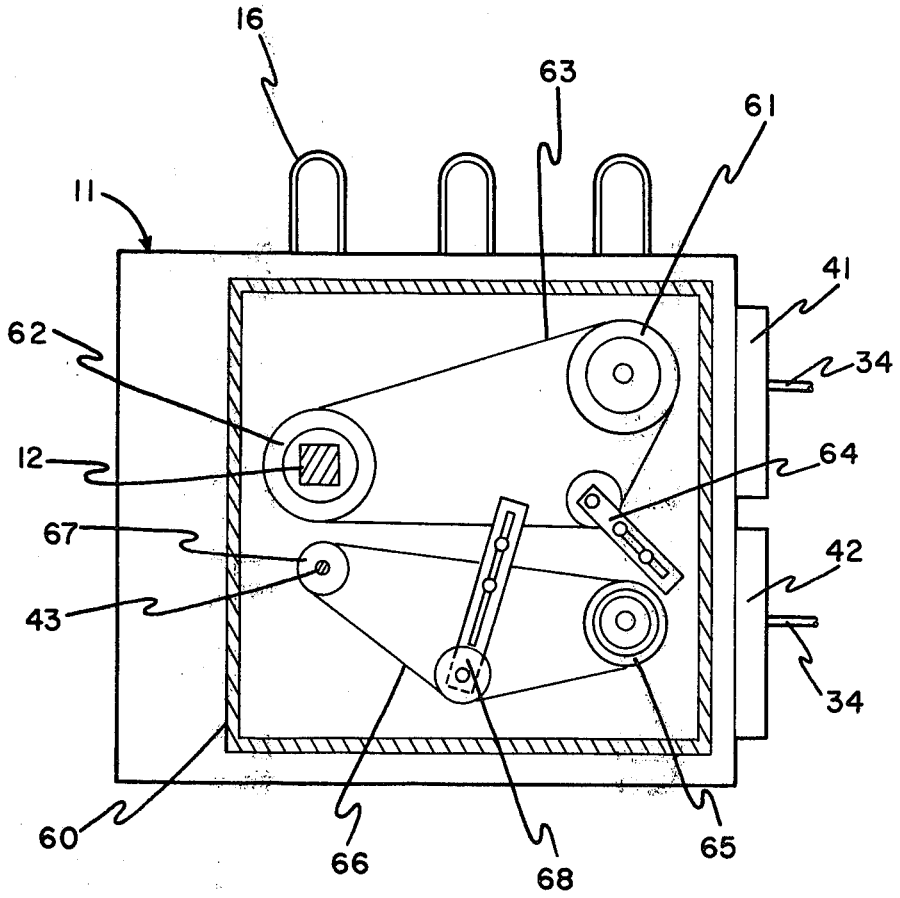
FIG. 3 is a sectional view of FIG. 2 taken along arrows 8—8.

FIGS. 2 and 3 show the decontamination machine 10 in greater detail, helping to disclose its operation. Lifting bails 16 on the housing 11 make the decontamination machine 10 portable so that it may be moved to any access hole needing decontamination. The housing 11 has an opening 14 which is large enough to encompass the access hole 23. It is through this opening 14 that the cleaning pig 50 and the shaft 12 pass to enter the access hole 23. An access door 15 is used to enter the housing 11 to attach the cleaning pig 50 to the shaft end 13.

A shielding door covers the opening 14. Preferably the shielding door has a main shielding part 71, a lower shielding gate 72 and an upper shielding gate 73. The main shielding part 71 has a top vertical slot which is wide enough to allow the shaft 12 to be rotatably disposed therein. The lower shielding gate 72 and the upper shielding gate 73 cover this slot area and are vertically hinged on one side to the main shielding part 71. These gates can be pushed to swing back or forth although they are spring-biased to a closed position covering the slot area. The main shielding part 71 is horizontally hinged on its bottom to the housing 11 so that the main shielding part 71 (with the attached gates 72 and 73) can, by rotation of an attached lever arm 70, be lowered back or raised forward within the housing 11 to uncover or cover the housing opening 14.

The shielding door can be opened or closed to any position by the shielding door opening and closing means. Preferably this is a pneumatic cylinder 40 whose piston 45 is connected to rotate the lever arm 70 which lowers and raises the shielding door's main shielding part 71. Other means include an electric motor with door opening linkage, or any other type of door opening and closing actuating device and could even include a manually operated lever. With the shielding door down, the cleaning pig 50 can be extended for operation. The shielding door can then be raised. As the main shielding part 71 (with the attached gates 72 and 73) is raised, the extended shaft 12 contacts the upper shielding gate 73 and then the lower shielding gate 72, "pushing" them to swing back as the extended shaft 12 enters the slot area of the rising main shielding part 71. With the main shielding part 71 fully raised, the upper shielding gate 73 will spring forward to a closed position while the lower shielding gate 72 will be held open by the extended shaft 12. It should be noted that the extended shaft 12 is free to rotate and/or translate within the slot area of the raised main shielding part 71.

The shaft 12 has a longitudinal axis and is disposed generally horizontally within the housing 11. Means are supplied for rotating the shaft end 13 about the shaft's longitudinal axis. Preferably, such means include an electric motor 41 coupled to a shaft rotation linkage contained within a covering 60. A typical shaft rotation linkage is shown in FIG. 3 where the electric motor 41 rotates a first sprocket 61 which turns a second sprocket 62 by means of a pulley chain 63 whose tension is controlled by a small idler assembly 64. The second sprocket 62 has a square opening through which the shaft 12 passes. Rotation of the second sprocket 62 rotates the shaft 12. It should be noted that the shaft 12 may be translated or pushed through the second sprocket 62, as discussed below, independently of shaft rotation. Other means include a pneumatic or other type of motor with shaft rotation linkage and could even include a manually operated shaft turning crank coupled to the shaft 12 by means of an extension.

Means are also supplied for translatably moving the shaft end 13 along the shaft's longitudinal axis from a beginning position within the housing 11 out through the housing opening 14 and access hole 23, without touching the access hole wall 24, into the chamber 21 and back again to the beginning position. Preferably, as shown in FIG. 2, such means include the shaft 12 being rotatably mounted to a drive plate 44. The drive plate 44, which can slide back and forth but not rotate due to the constraint of the housing, translatively moves the shaft 12 while allowing independent rotation of the shaft 12. Translation of the drive plate 44 is accomplished by rotation of the ball screw 43. A reversible electric motor 42 coupled to a ball screw rotation linkage provides the necessary rotation to the ball screw 43. A typical ball screw rotation linkage (contained within the covering 60 of FIG. 2) is shown in FIG. 3 where the reversible electric motor 42 rotates a first pulley wheel 65 which turns a second pulley wheel 67 by means of a pulley V belt 66 whose tension is controlled by a large idler assembly 68. Rotation of the second pulley wheel 67 rotates the ball screw 43. Other means include a pneumatic or other type of motor with ball screw rotation linkage and would even include a hand crank connected to the ball screw by an extension.

Air hoses 33 operate the pneumatic cylinder from the control cart 30 while electric cables 34 operate the electric motors 41 and 42 from the control cart 30. The control cart is supplied with typical activating buttons or levers to supply compressed air to the pneumatic cylinder and electricity to the motors.

Figure 4:
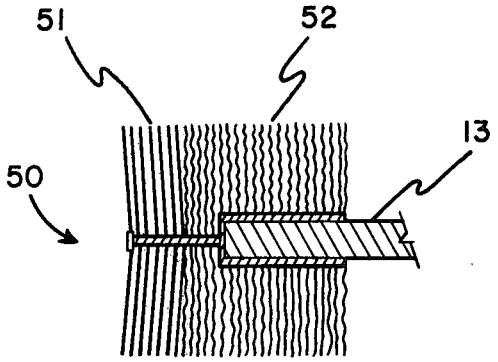
FIGS. 4 and 5 are sectional views showing alternate methods of attaching the cleaning pig to the shaft end.
Figure 5:
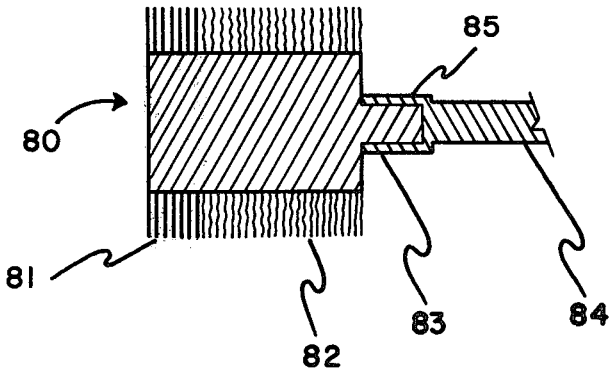

Means, such as that shown in FIG. 4, are provided for attaching the cleaning pig 50 to the shaft end 13 such that the pig 50 detaches from the shaft end 13 and falls into the chamber 21 when the shaft end 13 is translatably moved from within the chamber 21 to the access hole 23. Preferably, such attaching means include the shaft end 13 having a polygonal cross section and the cleaning pig 50 having a recess matching the shaft end 13. Preferably, the shaft end 13 has a square cross section. In addition, the cleaning pig 50 is preferably resiliently compressible. The cleaning pig 50 already has a diameter sufficient to circumferentially and compressibly contact the access hole wall 24. The cleaning pig 50 therefore has its diameter compressed while going through the access hole 23. Upon emerging within the chamber 21, the resiliently compressible cleaning pig 50 obtains a diameter greater than that of the access hole 23 such that when the shaft end 13 is moved out of the chamber 21, the circumference of the cleaning pig 50 will not pass through the access hole 23 as the shaft end 13 is withdrawn from the chamber 21. The detached cleaning pig 50 falls into the chamber 21. Alternate means for attachment, as shown in FIG. 5, would include the pig 80 having a polygonal (preferably square) plug 83 which fits within a matching socket 85 formed at the shaft end 84. Other means for attaching the cleaning pig 50 while allowing for detachment within the chamber 21 include a typical releasable attachment activated by electrical or mechanical devices passing through a coaxial passageway in the shaft 12.

The cleaning pig 50 shown in FIG. 4 (5) has a leading wire brush 51 (81) and trailing cloth disk 52 (82). Radioactive contamination loosened by the wire brush 51 (81) will be pushed by the cloth disk 52 (82) into the chamber 21.

The decontamination machine 10 may be equipped with limit switches and interlocks for safe operation. For example, the shielding door may be locked closed while the access door 15 is open, and the shaft 12 may be blocked from any motion while the shielding door is closed. Also, the shielding door's main shielding part 71 may be locked closed once the pig 50 (80) is in the access hole 23.

The operation of the decontamination machine 10 would proceed as follows. The decontamination machine 10 would be moved by the lifting bails 16 to an access hole 23 and positioned such that the opening 14, with the shielding door closed, is in front of and proximate the access hole 23. Since the access hole when not in use, such as after a manipulator has been withdrawn from the hot cell, is shielded by a detachable covering, that covering would now be removed. Preferably, the decontamination machine 10 would then be moved slightly so the shielding door would abut the access hole 23, and the housing 11 would then be bolted to the outside wall of the hot cell 20. The access door 15 would then be opened and a cleaning pig 50 would be manually attached to the shaft end 13. The access door 15 would be closed and the operator would go to the control cart 30 to open the shielding door. Using the actuators on the control cart 30, the operator would then translatably move the cleaning pig 50 until it just entered the access hole 23. At this point, the shielding door's main shielding part 71 would be raised and then the operator would begin decontamination cleaning by translating, rotating, or rotating and translating the shaft 12. When the cleaning pig 50 enters the chamber 21 and the shaft 12 is at its fullest extension, the operator would then reverse the direction of the reversible motor 42 to begin to translatably move the shaft 12 back into the housing 11. When the cleaning pig 50 would contact the chamber side of the access hole 23 it would automatically slide off and detach from the receding shaft 12 and fall into the chamber 21. When the shaft 12 fully recedes into the housing 11 the shielding door would completely close. Radiation monitors could check on the decontamination process, and a variety of additional cleaning pigs 50 would be used as appropriate. Eventually, enough used cleaning pigs would accumulate in the hot cell chamber to require their collection and removal through, for example, the large door areas usually located in the back of the hot cell chambers.

In summary, by using a shielding door, and a remotely operated rotating and translating cleaning pig to circumferentially clean and then detach within the chamber, a hot cell access hole can be decontaminated with essentially no radiation exposure to operating personnel.

The foregoing description of a preferred embodiment of the invention has been presented for purposes of illustration and description. It is not intended to be exhaustive or to limit the invention in the precise form disclosed, and obviously many modifications and variations are possible in light of the above teaching. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

I claim:

1. A system for removing radioactive contamination from the wall of a generally horizontal right circular cylindrical access hole in a chamber suitable for containing radioactivity, comprising:

(a) a portable housing, outside said chamber, having an opening, said housing moveable for positioning said opening in front of and proximate said access hole, and said opening large enough to encompass said access hole;

(b) a radiation shielding door attached to said housing and covering said opening, said shielding door providing a barrier to radioactivity;

(c) means for opening and closing said shielding door;

(d) a shaft, having a longitudinal axis and an end, disposed generally horizontally within said housing;

(e) means for rotatably moving said end of said shaft about said longitudinal axis;

(f) means for translatably moving said end of said shaft, along said longitudinal axis, from an initial position within said housing out through said opening and said access hole, without contacting said wall, into said chamber, and moving said end of said shaft back to said initial position;

(g) a generally right circular cylindrical cleaning pig having a sufficient diameter for said pig to circumferentially and compressibly contact said wall; and (h) means for attaching said cleaning pig to said end of said shaft so that said end of said shaft rotates said pig and pushes said pig from within said housing out through said opening and said access hole into said chamber, said pig circumferentially and compressibly contacting said wall to remove radioactive contamination thereon, and so that thereafter said pig detaches from said end of said shaft to fall into said chamber.

2. The system of claim 1 wherein said shielding door has at least two parts.

3. The system of claim 2 wherein said opening and closing means includes means for closing at least one of said shielding door parts, about said shaft, while allowing shaft rotation and translation, when said pig is in said access hole.

4. The system of claim 1 wherein said attaching means includes said end of said shaft having a polygonal cross section and said pig having a recess, matching said end, said end being disposed in said recess, and including said pig being resiliently compressible, so that said pig detaches from said end of said shaft to fall into said chamber when said end is translatably moved, along said longitudinal axis of said shaft, from said chamber to said access hole.

5. The system of claim 4 wherein said end of said shaft has a square cross section.

6. The system of claim 5 wherein said pig includes a wire brush.

7. The system of claim 6 wherein said pig includes a cloth disk, said cloth disk disposed posterior to said wire brush.

8. The system of claim 7 wherein said housing includes an access door, proximate said end of said shaft when said shaft is disposed within said housing, permitting manual attachment of said pig to said end of said shaft when said shielding door is closed.

* * * * *